US008264155B2

(12) United States Patent
Negley et al.

(10) Patent No.: US 8,264,155 B2
(45) Date of Patent: Sep. 11, 2012

(54) SOLID STATE LIGHTING DEVICES PROVIDING VISIBLE ALERT SIGNALS IN GENERAL ILLUMINATION APPLICATIONS AND RELATED METHODS OF OPERATION

(75) Inventors: Gerald H. Negley, Chapel Hill, NC (US); Antony P. van de Ven, Sai Kung (HK)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 12/910,022

(22) Filed: Oct. 22, 2010

(65) Prior Publication Data

US 2011/0084616 A1 Apr. 14, 2011

Related U.S. Application Data

(63) Continuation-in-part of application No. 12/574,021, filed on Oct. 6, 2009.

(51) Int. Cl.
*H01J 7/42* (2006.01)

(52) U.S. Cl. ..... 315/129; 315/130; 315/131; 315/360

(58) Field of Classification Search ..... 315/129, 315/130, 131, 132, 133, 136, 119, 120, 121, 315/122, 123, 127
See application file for complete search history.

(56) References Cited

U.S. PATENT DOCUMENTS 6,239,716 B1 * 5/2001 Pross et al. ..... 340/815.4
6,717,559 B2 4/2004 Weindorf
6,848,819 B1 2/2005 Arndt et al.
6,860,621 B2 3/2005 Bachl et al.
6,900,471 B1 5/2005 Wicke et al.
7,144,135 B2 12/2006 Martin et al.
7,193,299 B2 3/2007 Arndt et al.
7,319,298 B2 1/2008 Jungwirth et al.
7,439,549 B2 10/2008 Marchi et al.
7,456,500 B2 11/2008 Kromotis et al.
7,559,674 B2 7/2009 He et al.
7,560,741 B2 7/2009 Harle et al.
2002/0097000 A1 7/2002 Muthu et al.
2002/0167637 A1 * 11/2002 Burke et al. ..... 349/161
2002/0171365 A1 * 11/2002 Morgan et al. ..... 315/56
2002/0195945 A1 * 12/2002 Gershen et al. ..... 315/55
2003/0063463 A1 4/2003 Sloan et al.
2007/0139319 A1 6/2007 Nishida et al.
2007/0279906 A1 12/2007 He et al.

(Continued)

OTHER PUBLICATIONS

International Search Report and Written Opinion, PCT/US2010/049577, Nov. 17, 2010.

(Continued)

*Primary Examiner* — Douglas W Owens
*Assistant Examiner* — Jianzi Chen
(74) *Attorney, Agent, or Firm* — Myers Bigel Sibley & Sajovec

(57) ABSTRACT

A solid state lighting apparatus includes a plurality of light emitting diodes, a sensor configured to output a sensor signal indicative of at least one operating condition of the solid state lighting apparatus, and a control circuit coupled to the sensor. The control circuit is configured to temporarily interrupt electrical current to ones of the plurality of light emitting diodes at respective intervals responsive to the sensor signal indicating that the operating condition does not meet a desired operating threshold to provide a visible indicator thereof in light emitted by the apparatus. Related devices and methods of operation are also discussed.

30 Claims, 5 Drawing Sheets

U.S. PATENT DOCUMENTS

| | | | | |
|---|---|---|---|---|
| 2008/0129220 | A1* | 6/2008 | Shteynberg et al. | 315/291 |
| 2008/0174929 | A1* | 7/2008 | Shen et al. | 361/103 |
| 2008/0191631 | A1* | 8/2008 | Archenhold et al. | 315/158 |
| 2008/0197788 | A1 | 8/2008 | Conover et al. | |
| 2009/0013570 | A1 | 1/2009 | Grajcar | |
| 2009/0085494 | A1* | 4/2009 | Summerland | 315/291 |
| 2009/0153075 | A1 | 6/2009 | Li et al. | |
| 2010/0052542 | A1* | 3/2010 | Siemiet et al. | 315/129 |
| 2010/0148701 | A1* | 6/2010 | Yu et al. | 315/309 |

OTHER PUBLICATIONS

International Preliminary Report on Patentability Corresponding to International Application No. PCT/US2010/049577; Date of Mailing: Apr. 19, 2012; 7 Pages.

* cited by examiner

SOLID STATE LIGHTING DEVICES PROVIDING VISIBLE ALERT SIGNALS IN GENERAL ILLUMINATION APPLICATIONS AND RELATED METHODS OF OPERATION

CROSS-REFERENCE TO RELATED APPLICATIONS

This application is a continuation-in-part of U.S. patent application Ser. No. 12/574,021 entitled "Solid State Lighting Devices Including Thermal Management and Related Methods" filed Oct. 6, 2009, the disclosure of which is incorporated by reference herein in its entirety

FIELD

The present invention relates to solid state lighting, and more particularly to solid state lighting devices and methods for general illumination.

BACKGROUND

Solid state lighting devices are used for a number of lighting applications. For example, solid state lighting panels including arrays of solid state lighting devices have been used as direct illumination sources, four example, in architectural and/or accent lighting. A solid state lighting device may include, for example, a packaged light emitting device (LED) including one or more light emitting diode chips. Inorganic LEDs typically include semiconductor layers forming p-n junctions. Organic LEDs (OLEDs), which include organic light emission layers, are another type of solid state light emitting device. Typically, a solid state light emitting device generates light through the recombination of electronic carriers, i.e. electrons and holes, in a light emitting layer or region. LED chips, or dice, can be mounted in many different ways for many different applications. For example, an LED chip can be mounted on a header and enclosed by an encapsulant for protection, wavelength conversion, focusing, dispersion/scattering, etc. LED chips can also be mounted directly to a submount, such as a PCB, and can be coated directly with a phosphor, such as by electrophoresis or other techniques. Accordingly, as used herein, the term "light emitting diode" or "LED" can refer to an LED chip, including an LED chip coated or otherwise provided with phosphor, or to a packaged device, such as a packaged device that includes an LED chip and that provides electrical contacts, primary optics, heat dissipation, and/or other functional features for the LED chip.

Recently solid state lighting systems have been developed for general illumination applications. The design of a solid state lighting system for general illumination typically involves designing optical, power and thermal management systems in order to provide a particular level of performance with respect to lumen output, power requirements and junction temperature of Light Emitting Diode (LED) light sources. The junction temperature of the LEDs may be a significant factor in the lifetime of the LEDs. In particular, if the junction temperature exceeds the recommended junction temperature of the manufacturer, then the LEDs will typically not achieve the expected lifetime. Changes in operating temperature can also result in color shifts in the resulting light output of the LEDs. Thus, maintaining the LEDs at an appropriate junction temperature may be an important consideration in the design of solid state lighting systems. However, as solid state lighting systems may be used in a variety of applications, such as in different fixtures, in different environmental conditions, and/or in different operating regimes, it may be difficult to design solid state lighting systems to account for such varied operating conditions.

The design of thermal management for solid state lighting systems has generally fallen into two categories: passive systems and active systems. Passive systems have typically been integral to the lighting device. For example, the LR6 recessed downlight from Cree LED Lighting Solutions of Morrisville, N.C., utilizes a passive system that incorporates a heat sink that is exposed to the room in which the LR6 is mounted. Thus, the LR6 provides not only the light source but also the trim for a recessed fixture in which the LR6 is mounted. By exposing the heat sink to the room, the LR6 benefits from any air currents that break the boundary layer between the heat sink and the air in the room. Breaking the boundary layer between a heat sink and its environment can increase the efficacy of the heat sink, thereby lowering the junction temperature of the LEDs.

Active thermal management for solid state lighting systems has also been utilized. For example, U.S. Pat. No. 7,144,135 entitled "LED Lamp Heat Sink" describes an LED lamp that includes a fan that moves air over a heat sink. Additionally, LED downlights with integral synthetic jet cooling systems have also been announced. However, current solutions may rely on specifically designed fixtures, structures, and/or environments, which may be inadequate and/or unascertainable to designers and/or manufacturers of the LED modules used in such fixtures, structures, and/or environments.

SUMMARY

According to some embodiments of the present invention, a solid state lighting apparatus includes a plurality of light emitting diodes, a sensor configured to output a sensor signal indicative of at least one operating condition of the solid state lighting apparatus, and a control circuit coupled to the sensor. The control circuit is configured to temporarily interrupt electrical current to at least one of the plurality of light emitting diodes responsive to a value of the sensor signal to provide a visible indicator of the operating condition.

In some embodiments, the value of the sensor signal may indicate that the operating condition differs with respect to a desired operating threshold.

In some embodiments, the control circuit may be configured to temporarily interrupt the electrical current for at least two intervals of respective durations sufficient to provide an appearance of a flashing light pattern that is detectable by a human eye in the light emitted by the apparatus.

In some embodiments, the solid state lighting apparatus is configured to provide general illumination responsive to operation of a driver circuit that is configured to provide the electrical current to the plurality of light emitting diodes.

In some embodiments, the driver circuit may be configured to reduce the electrical current provided to the plurality of light emitting diodes responsive to the value of the sensor signal indicating that the operating condition does not meet the desired operating threshold. The control circuit may be configured to temporarily interrupt the reduced electrical current at the respective intervals.

In some embodiments, the apparatus may be an illumination module that is configured to be connected to an external driver circuit and mounted in an application-specific structure.

In some embodiments, the solid state lighting apparatus may be a LED module included in a self-ballasted lamp.

In some embodiments, the plurality of light emitting diodes may be a first plurality of light emitting diodes. The apparatus may further include a second plurality of light emitting diodes configured to emit light having a different dominant wavelength than the first plurality of light emitting diodes. The control circuit may further be configured to maintain the electrical current to the second plurality of light emitting diodes while selectively interrupting the electrical current to the first plurality of light emitting diodes responsive to the sensor signal.

In some embodiments, the control circuit may be configured to alternately interrupt electrical current to the first plurality of light emitting diodes and to the second plurality of light emitting diodes responsive to the sensor signal including a value that exceeds a high temperature limit.

In some embodiments, the control circuit may include a comparator circuit and a timer circuit. The comparator circuit may be configured to compare a value of the sensor signal to a value indicative of the desired operating threshold, and to provide a fault signal responsive to the sensor signal value being greater than or less than the desired operating threshold value. The timer circuit may be configured to provide a switching signal to temporarily interrupt the electrical current at the respective intervals responsive to the fault signal.

In some embodiments, the control circuit may be configured to temporarily interrupt the electrical current to the ones of the plurality of light emitting diodes at the respective intervals independent of a subsequent value of the sensor signal.

In some embodiments, the control circuit may be configured to cease interruption of the electrical current to the ones of the plurality of light emitting diodes responsive to a power-on-reset signal.

In some embodiments, the respective durations for which the electrical current is temporarily interrupted and/or times between the respective intervals may be sufficient to reduce a subsequent value of the sensor signal.

In some embodiments, the control circuit may be configured to cease interruption of the electrical current to the ones of the plurality of light emitting diodes responsive to the subsequent value of the sensor signal indicating that the operating condition meets the desired operating threshold.

In some embodiments, the control circuit may be configured to temporarily interrupt the electrical current to the ones of the plurality of light emitting diodes at the respective intervals independent of a time at which the sensor signal indicates that the operating condition does not meet the desired operating threshold.

In some embodiments, the respective intervals comprise periodic intervals.

In some embodiments, the operating condition may be one of a plurality of operating conditions, and the flashing light pattern may indicate the one of the plurality of operating conditions based on the respective durations for which the electrical current is temporality interrupted, the period of the respective intervals, and/or a color of the light emitted by the apparatus.

In some embodiments, the flashing light pattern may indicate a severity of the operating condition based on the respective durations for which the electrical current is temporality interrupted, the period of the respective intervals, and/or a color of the light emitted by the apparatus.

In some embodiments, the sensor may be a thermal sensor, and the operating condition may be a junction temperature and/or an ambient temperature of an operating environment of at least one of the plurality of light emitting diodes.

In some embodiments, the sensor may be an optical sensor, and the operating condition may be a color rendering index (CRI) for the solid state lighting apparatus.

In some embodiments, the sensor may be a humidity sensor, and the operating condition may be a humidity level of an operating environment of the solid state lighting apparatus.

In some embodiments, the solid state lighting apparatus may further include an external interface configured to receive an external input signal. The control circuit may be further configured to temporarily interrupt the electrical current to at least one of the plurality of light emitting diodes responsive to the external input signal to provide a second visible indicator independent of the operating condition indicated by the sensor signal.

In some embodiments, the plurality of light emitting diodes may provide a LED module included in a self-ballasted lamp. Some embodiments provide that the apparatus includes an illumination module that is configured to be connected to a LED driver circuit and mounted in an application-specific structure.

According to further embodiments of the present invention, in a method of operating a solid state lighting apparatus including a plurality of light emitting diodes, a sensor signal indicative of at least one operating condition of the solid state lighting apparatus is received from a sensor. Electrical current is temporarily interrupted to at least one of the plurality of light emitting diodes responsive to a value of the sensor signal to provide a visible indicator of the operating condition.

In some embodiments, the sensor signal may indicate that the operating condition differs with respect to a desired operating threshold.

In some embodiments, the electrical current may be temporarily interrupted for at least two intervals of respective durations sufficient to provide an appearance of a flashing light pattern that is detectable by a human eye in the light emitted by the apparatus.

In some embodiments, the electrical current may be received from a driver circuit, and the electrical current may be provided to the plurality of light emitting diodes such that the light emitted by the apparatus provides general illumination prior to temporarily interrupting the electrical current.

In some embodiments, the plurality of light emitting diodes may be a first plurality of light emitting diodes, and the solid state lighting apparatus may include a second plurality of light emitting diodes configured to emit light having a different dominant wavelength than the first plurality of light emitting diodes. The electrical current may be maintained to the second plurality of light emitting diodes while temporarily interrupting the electrical current to the first plurality of light emitting diodes responsive to the sensor signal indicating that the operating condition exceeds the desired operating threshold.

In some embodiments, the electrical current may be temporarily interrupted at the respective intervals independent of a subsequent value of the sensor signal and/or independent of a time at which the sensor signal indicates that the operating condition exceeds the desired operating threshold.

In some embodiments, an external input signal may be received from an external interface, the electrical current may be temporarily interrupted to ones of the plurality of light emitting diodes at respective intervals responsive to the external input signal to provide a second visible indicator independent of the operating condition indicated by the sensor signal.

According to still further embodiments of the present invention, a method of operating a solid state lighting apparatus includes providing general illumination using a plurality of light emitting diodes. An operating condition of the solid state lighting apparatus is detected, and current to at least one of the light emitting diodes is controlled in response to detecting the operating condition to provide a visible indicator of the operating condition.

Other methods and/or devices according to some embodiments will become apparent to one with skill in the art upon review of the following drawings and detailed description. It is intended that all such additional embodiments, in addition to any and all combinations of the above embodiments, be included within this description, be within the scope of the invention, and be protected by the accompanying claims.

BRIEF DESCRIPTION OF THE DRAWINGS

The accompanying drawings, which are included to provide a further understanding of the invention and are incorporated in and constitute a part of this application, illustrate certain embodiment(s) of the invention. In the drawings.

DETAILED DESCRIPTION

Figure 1:
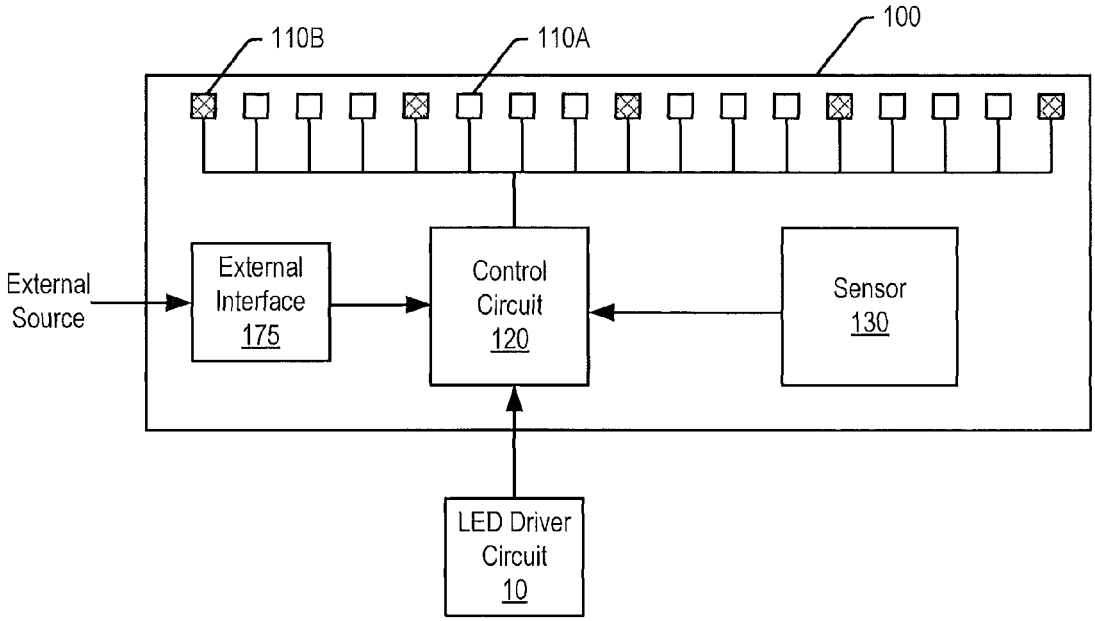
FIG. 1 is a block diagram illustrating a solid state lighting apparatus and methods of operation according to some embodiments of the present invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly cm" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "front" or "back" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be, limiting of the invention. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this disclosure and the relevant art and will not be interpreted in an idealized or overly formal sense unless expressly so defined herein.

The term "phosphor" may be used herein to refer to any materials that absorb light at one wavelength and re-emit light at a different wavelength, regardless of the delay between absorption and re-emission and regardless of the wavelengths involved. Accordingly, the term "phosphor" may be used herein to refer to materials that are sometimes called fluorescent and/or phosphorescent. In general, phosphors absorb light having shorter wavelengths and re-emit light having longer wavelengths. As such, some or all of the excitation light emitted by an LED chip at a first wavelength may be absorbed by the phosphor particles, which may responsively emit light at a second wavelength. A fraction of the light may also be reemitted from the phosphor at essentially the same wavelength as the incident light, experiencing little or no down-conversion.

Some embodiments of the present invention provide a visible indicator of an operating condition that may be detrimental to the performance of a solid state lighting apparatus by repeatedly interrupting and resuming the flow of electrical current to one or more LEDs during operation of a lighting apparatus to produce a visible light pattern. For example, in a general illumination application, the solid state lighting apparatus may flash or blink if a temperature condition is detected that exceeds an upper temperature limit or if another operating condition does not meet some other operating range. Thus, general illumination may be temporarily interrupted to indicate a detrimental operating condition, for instance, before a fault and/or other significant damage occurs that may reduce the operating lifetime of the LEDs. In some embodiments, the solid state lighting apparatus may alternately interrupt current to LED strings of different colors to provide a flashing light pattern and/or general illumination of a different color. Different flashing light patterns may also be used to indicate particular operating conditions and/or a severity of an operating condition. The visible indicator may be provided for a fixed period of time, or until power is cycled to the apparatus. The visible indicator may be implemented in the design of the overall solid state lighting system, or may be implemented in the LED module itself for use in a variety of systems. Including the visible indicator in the design of the LED module itself may offer ease in both design and installation phases of solid state lighting systems.

FIG. 1 is a block diagram illustrating a solid state lighting apparatus 100 according to some embodiments of the present invention. The lighting apparatus 100 may include an array of multiple solid state light emitters (e.g., diodes, light emitting diodes, LEDs, etc.) 110. In particular, the apparatus 100 of FIG. 1 includes first LEDs 110A and second LEDs 110B configured to provide different emission characteristics. In some embodiments, the lighting apparatus 100 may be a LED module that is configured to emit substantially white light that is a combination of light emitted by first and second LEDs 110A, 110B, for example, for general illumination purposes.

White light can be a mixture of light of many different wavelengths. There are many different hues of light that may be considered "white". For example, some "white" light, such as light generated by sodium vapor lighting devices, may appear yellowish in color, while other "white" light, such as light generated by some fluorescent lighting devices, may appear more bluish in color. Also, a binary combination of light from two different light sources may appear to have a different color than either of the two constituent colors. The color of the combined light may further depend on the relative intensities of the two light sources. For example, light emitted by a combination of a blue source and a red source may appear purple or magenta to an observer. Similarly, light emitted by a combination of a blue source and a yellow source may appear white to an observer.

The ability of a light source to accurately reproduce color in illuminated objects is typically characterized using the color rendering index (CRI). In particular, CRI is a relative measurement of how the color rendering properties of an illumination system compare to those of a black-body radiator. A CRI of 100 indicates that the color coordinates of a set of test colors being illuminated by the illumination system are the same as the coordinates of the same test colors being irradiated by the black-body radiator. Daylight has the highest CRI (of 100), with incandescent bulbs being relatively close (about 95), and fluorescent lighting being less accurate (70-85).

For backlight and illumination applications, it is often desirable to provide a lighting source that generates white light having a high CRI, so that objects illuminated by the lighting source may appear more natural. Accordingly, such lighting sources may typically include an array of solid state lighting devices including red, green, and blue light emitting devices. When red, green, and blue light emitting devices are energized simultaneously, the resulting combined light may appear white, or nearly white, depending on the relative intensities of the red, green and blue sources. However, the combination of light from red, green, and blue light emitting devices does not guarantee a high CRI, particularly if the emitters generate saturated light, because such light may lack contributions from many visible wavelengths.

In this regard, the lighting apparatus 100 according to some embodiments includes a plurality of light emitting diodes (LEDs) including at least a first LED 110A and a second LED 110B. Chromaticities of the first and second LEDs 110A, 110B may be selected so that a combined light generated by a mixture of light from the pair of LEDs has about a target chromaticity, which may for example be white. In some embodiments, the first LED 110A includes a first LED chip that emits light in the blue portion of the visible spectrum and a phosphor, such as a red phosphor, that is configured to receive at least some of the light emitted by the blue LED chip and responsively emit red light. In particular embodiments, the first LED chip may have a dominant wavelength from about 430 nm to about 480 nm, and in some cases from about 450 nm to about 460 nm, and the phosphor may emit light having a dominant wavelength from about 600 nm to about 630 nm in response to light emitted by the first LED. The second LED 110B may emit light having a color point that lies in a green, yellowish green, or green-yellow portion of the 1931 CIE Chromaticity Diagram. As such, the combination of the light from the first and second LEDs 110A, 110B may provide the appearance of white light.

In some embodiments, the lighting apparatus 100 may include LED/phosphor combinations as described in U.S. Pat. No. 7,213,940, issued May 8, 2007, and entitled "LIGHTING DEVICE AND LIGHTING METHOD," the disclosure of which is incorporated by reference as if set forth fully herein. In particular, the lighting apparatus 100 may include solid state light emitters (i.e., LED chips) that emit light having dominant wavelength in ranges of from 430 nm to 480 nm (e.g., in the blue portion of the visible spectrum), and a group of phosphors that emit light having dominant wavelength in the range of from 555 nm to 585 nm (e.g., in the yellow portion of the visible spectrum). A combination of light by the first group of emitters, and light responsively emitted by the group of phosphors produces a sub-mixture of light that is referred to herein as "blue-shifted yellow" or "BSY." Such light may, when combined with light having a dominant wavelength from 600 nm to 630 nm (e.g., in the red portion of the visible spectrum), produce an appearance of warm white light. As used herein, "warm white" may refer to white light with a CCT of between about 2600K and 6000K, which is more reddish in color. Accordingly, in some embodiments of the present invention, the first LED 110A includes a first LED chip that emits light in the blue portion of the visible spectrum and a phosphor that responsively emits light in the yellow portion of the visible spectrum, and the second LED 110B includes a second LED chip that emits light in the red portion of the visible spectrum. Such a combination produces a mixture of light that is referred to herein as "blue-shifted yellow plus red" or "BSY+R."

Some embodiments provide that the lighting apparatus 100 may further include a third LED chip (not illustrated) that emits light in the blue or green portion of the visible spectrum and that has a dominant wavelength that may be at least about 10 nm greater than a dominant wavelength of the first LED chip. That is, a third LED chip may be provided that may "fill in" some of the spectral gaps that may be present in light emitted by the lighting device, to thereby improve the CRI of the device. The third LED chip may have a dominant wavelength that may be at least about 20 nm greater, and in some embodiments about 50 nm or more greater, than the dominant wavelength of the first LED chip.

A lighting apparatus 100 as described herein may include a linear illumination module that includes multiple surface mount technology (SMT) packaged LEDs arranged in an array, such as a linear array, on a printed circuit board (PCB), such as a metal core PCB (MCPCB), a standard FR-4 PCB, or a flex PCB. The LEDs may include, for example, XLamp® brand packaged LEDs available from Cree, Inc., Durham, N.C. The array can also include a two-dimensional array of LEDs.

Although not illustrated, a support member may be used to provide mechanical retention and/or thermal transfer to a surface on which the module may be mounted. Other passive or active electronic components may be additionally mounted on the PCB and connected to serve a particular function. Such components can include resistors, diodes, capacitors, transistors, thermal sensors, optical sensors, amplifiers, microprocessors, drivers, digital communication devices, RF or IR receivers or transmitters and/or other components, for example. The module may include openings that may be covered by one or more optical elements and/or structures. Although not illustrated, such optical elements may include a simple transmissive diffuser, a surface embossed holographic diffuser, a brightness enhancing film (BEF), a Fresnel lens, TIR or other grooved sheet, a dual BEF (DBEF) or other polarizing film, a micro-lens array sheet, or other optical sheet. Reflective sheets, films, coatings and/or surfaces may also be provided in some embodiments.

Thus, as described above, the first LEDs 110A may be BSY LEDs configured to emit substantially white light, and the second LEDs 110B may be red LEDs configured to emit red light (e.g., having a dominant wavelength from 600 nm to 630 nm) to produce an appearance of warm white light.

As shown in FIG. 1, the lighting apparatus 100 is configured to receive electrical current as one or more drive signals from a LED driver circuit 10, which may or may not be included in the lighting apparatus 100. For example, in some embodiments, the lighting apparatus 100 may be a LED module that is provided to a device and/or system manufacturer to be used in an application and/or environment having characteristics that may be unascertainable to the LED module supplier. Accordingly, the LED module supplier may lack knowledge regarding specific application and/or environmental conditions, which may exceed a design and/or test standard corresponding to the LED module. For example, an LED module may be rated to include an operating life that is dependent on specific operating conditions, such as, for example, temperature. Such devices and/or systems may be designed to include the LED driver 10 as an external component separate from the lighting apparatus 100.

Still referring to FIG. 1, to detect and/or indicate one or more operating conditions that exceed those designated by a LED module manufacturer, the lighting apparatus 100 includes a sensor 130 that is configured to provide a signal indicative of one or more operating conditions of the lighting apparatus 100. For example, the sensor 130 may be a thermal sensor that outputs a temperature signal indicative of a present operating temperature of the apparatus 100. In some embodiments, the operating temperature may indicate a junction temperature corresponding to one or more of the light emitting diodes 110A, 110B and/or an ambient temperature corresponding to that of the operating environment of the apparatus 100. A thermal sensor may include a thermistor, a resistance temperature detector (RTD), and/or a thermocouple, among others. Additionally or alternatively, the sensor 130 may include an optical sensor that outputs a CRI signal indicative of a present CRI of the light emitted by the apparatus, and/or a humidity sensor that outputs a humidity signal indicative of a present moisture level of the environment in which the apparatus 100 is being used. Other sensors configured to detect particular operating conditions of the apparatus 100 may also be included in the sensor 130.

The lighting apparatus 100 further includes a control circuit 120 coupled to the LED driver circuit 10 and the sensor 130. The control circuit 120 is configured to receive the electrical current from the LED driver circuit 10 and the sensor signal from the sensor 130, and is configured to temporarily interrupt electrical current to one or more of the LEDs 110A, 110B at repeated intervals if a value of the signal from the sensor 130 exceeds or differs with respect to a desired operating threshold or a desired operating range. For example, if a value of the temperature signal from the sensor 130 exceeds a high temperature limit, electrical current to at least some of the LEDs 110A, 110B may be temporarily interrupted to cause those LEDs 110A, 110B to turn off and on. The duration of each interruption of current (e.g., the "off-time") is sufficient to provide an appearance of a flashing light pattern in the light output of the lighting apparatus 100, thereby providing a visible indicator that the operating temperature exceeds a specified limit. Specifically, the duration of each temporary interruption of current is sufficient to provide an appearance of flashing or blinking light that is detectable by the human eye. For example, the duration of each interruption may be selected to provide a flicker rate of less than about 16 Hz. In addition, the temporary interruption of current to some or all of the LEDs 110A, 110B reduces the operating time of the LEDs 110A, 110B, thereby reducing the junction temperatures of the LEDs 110A, 110B.

In some embodiments, the control circuit 120 may be configured to maintain electrical current to the second LEDs 110B while switching the first LEDs 110A off and on in response to the value of the signal from the sensor 130 exceeding a desired operating threshold, such that the second LEDs 110B continue to emit light. For example, where the first LEDs 110A are BSY LEDs and the second LEDs 110B are red LEDs, temporarily interrupting the electrical current to the first LEDs 110A while maintaining electrical current to the second LEDs 110B may cause the lighting apparatus 100 to cycle or flash between red light and white light output. The flashing of light between the two colors may thereby provide a visible indicator of a detrimental operating condition. The control circuit 120 may be further configured turn off the first LEDs 110A for an extended duration while switching the second LEDs 110B off and on in response to the value of the signal from the sensor 130 exceeding a desired operating threshold, such that only the second LEDs 110B provide the flashing light pattern. Accordingly, in some embodiments, the control circuit 120 may be configured to alternatingly change the visible appearance of the light emitted from the lighting apparatus 100 between two colors responsive to a high temperature operating condition. In contrast, merely changing the visible appearance of light to a single color (e.g., by turning off either the first LEDs 110A or the second LEDs 110B) for an extended amount of time could be misconstrued as a failure of the lighting apparatus 100 (e.g., as a failure of a particular string of LEDs).

The control circuit 120 may be further configured to continue to receive and/or update a value of the signal from the sensor 130 even after an operating condition in excess of a desired operating threshold is detected and one or more of the LEDs 110A, 110B are repeatedly turned off and on. In some embodiments, if after interrupting electrical current to one or more of the LEDs 110A, 110B, a subsequent value of the signal from the sensor 130 decreases to indicate a reduction in the operating condition below the desired threshold and/or within the desired range, continuous electrical current may be resumed to the one or more LEDs 110A, 110B. For example, a restore function temperature value may be defined to trigger the restoration of the electrical current to the LEDs 110A, 110B. In particular, a restore function temperature value may be less than the high temperature limit such that a hysteresis control characteristic may be provided. In addition and/or alternatively, the control circuit 120 may be configured to calculate and select the timing between intervals of current interruption and/or the off-time during each interval to be sufficient to reduce the value of the sensor signal below the desired operating threshold.

Conversely, in some embodiments, the control circuit 120 may be configured to continue interrupting electrical current to one or more of the LEDs 110A, 110B at the respective intervals independent of a subsequent value of the signal from the sensor 130, e.g., for a minimum amount of time regardless of an updated or subsequent value of the sensor signal. For example, once the temperature signal from a thermal sensor exceeds a high temperature limit, the electrical current to the first one or more of the LEDs 110A, 110B may be interrupted for some fixed amount of time including a specified number of seconds, minutes and/or hours. In some embodiments, the fixed amount of time may be triggered from the time that the current is first interrupted and/or from the time that the temperature signal value is less than the restore function temperature. In addition and/or alternatively, the control circuit 120 may be configured to continue interrupting electrical current to one or more of the LEDs 110A, 110B until a power-on-reset (POR) signal is received.

Some embodiments provide that the control circuit 120 is configured to intermittently interrupt the electrical current to one or more of the LEDs 110A, 110B at different intervals and/or for different durations to indicate different detrimental operating conditions of the apparatus 100. For example, in some embodiments, more than one high temperature limit value may be provided. As such, the control circuit 120 may be configured to interrupt the current to one or more of the LEDs 110A, 110B at a first interval when the temperature signal value exceeds a first high temperature limit, and at a second interval when the temperature signal value exceeds a second high temperature limit. In some embodiments, the current interruption may be alternating with non-interrupted intervals to create an on/off sequence or light pattern. For example, in response to the temperature signal exceeding the first high temperature limit, the control circuit 120 may be configured to periodically interrupt the electrical current to the first LEDs 110A for a 10 second duration every 20 seconds. In contrast, in response to the temperature signal exceeding the second high temperature limit, the control circuit 120 may be configured to periodically interrupt the electrical current to the first LEDs 110A for a one second duration every two seconds. In some embodiments, the first high temperature limit may correspond to an emitter junction temperature and/or the second high temperature may correspond to an ambient temperature, among others. In this manner, a visible appearance of the light output from the lighting apparatus 100 may change in different ways to signal different respective operating conditions. In addition, the control circuit 120 may be configured to use a shorter duration and/or period between intervals of current interruption to create flashing patterns of different frequencies, which may be used to indicate a severity of an operating condition. For example, a higher-frequency and/or red flashing light pattern may provide a visible indicator of a higher junction temperature than a lower-frequency and/or white flashing light pattern.

The visible indicator provided by solid state lighting apparatus according to some embodiments of the present may also be used to indicate information other than the presence of detrimental operating conditions. For example, based on historical data from the sensor 130 (such as temperature, humidity, and/or other operating condition data collected over a period of time), the control circuit 120 may be configured to estimate a remaining operating lifetime of the LEDs 110A, 110B, and may output a control signal to temporarily interrupt current to one or more the LEDs 110, 110B at the repeating intervals to provide a visible indication of the remaining operating lifetime. For instance, the control circuit 120 may be configured to provide a flashing light pattern upon power-up of the solid state lighting apparatus 100, the frequency and/or color of which may indicate the remaining operating lifetime. As such, the visible indicator may be provided to indicate usage and/or time-based conditions.

In addition, the control circuit 120 may be configured to provide the visible indicator in response to signal received from sources other than the sensor 130. In particular, as shown in FIG. 1, the control circuit 120 may provide a flashing light pattern in response to a signal from an external source received via an external interface 175. The external source may be, for example, a backup power system and/or an emergency broadcast system. In particular embodiments, in the event of a power failure and/or emergency situation, the solid state lighting apparatus 100 may be configured to be powered by a backup battery. As such, the backup battery may provide the signal indicating remaining battery power to the external interface 175, and the control circuit 120 may temporarily interrupt power at repeating intervals to provide a visible indicator of the remaining battery power and/or that less than a particular amount of battery life remains. Also, in the event of an emergency, the external signal may be provided from an emergency system to indicate the presence of an emergency condition (such as a building fire or a hurricane), and the control circuit 120 may temporarily interrupt power at repeating intervals to provide a visible indicator of the emergency condition. Accordingly, the visible indicator provided by solid state lighting apparatus according to some embodiments of the present invention may be used to indicate a variety of conditions, in addition to or instead of detrimental operating conditions.

Although embodiments of the present invention are generally described above with reference to thermal energy-related operating conditions, embodiments of the present invention are not so limited. For example, in some embodiments, instead of a thermal sensor, a humidity sensor may be used to provide a moisture signal, which may be compared to a humidity threshold. In this regard, the visible characteristics of the light emitted from a lighting apparatus may be changed responsive to detecting a high humidity operating condition. Also, some embodiments provide that electrical current to third LEDs (not illustrated) may be interrupted instead of and/or in combination with that of the first and/or second LEDs 110A, 110B to provide other similar visible appearance changes responsive to the detection of different respective operating conditions.

Figure 2A:
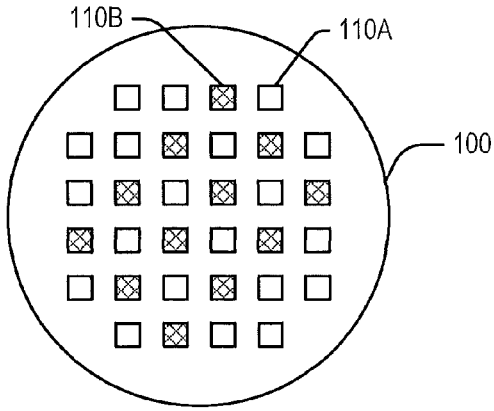
FIGS. 2A and 2B are front views of different respective configurations of a solid state lighting apparatus according to some embodiments of the present invention.
Figure 2B:
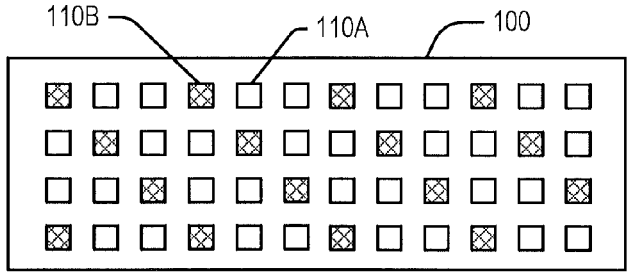

FIGS. 2A and 2B are front views illustrating different configurations of a solid state lighting apparatus according to some embodiments of the present invention. The solid-state lighting apparatus 100 may include a plurality of first LEDs 110A and a plurality of second LEDs 110B. In some embodiments, the plurality of first LEDs 110A may include white emitting and/or non-white emitting, light emitting devices. The plurality of second LEDs 110B may include light emitting devices that emit light having a different dominant wavelength from the first LEDs 110A, so that combined light emitted by the first LEDs 110A and the second LEDs 110B may have a desired color and/or spectral content. For example, the combined light emitted by the plurality of first LEDs 110A and the plurality of second LEDs 110B may provide warm white light that has a high color rendering index.

Blue and/or green LED chips used in a lighting apparatus according to some embodiments may be InGaN-based blue and/or green LED chips available from Cree, Inc., the assignee of the present invention. For example, the LED chips may include EZBright® power chips manufactured by Cree, Inc. EZBright® power chips have been demonstrated with an external quantum efficiency (i.e., the product of internal quantum efficiency and light extraction efficiency) as high as 50% at 50 A/cm$^2$ corresponding to greater than 450 mW of optical output power at 350 mA drive current. Red LEDs used in the lighting apparatus may be, for example, AlInGaP LED chips available from Epistar, Osram and others.

As discussed above with reference to FIG. 1, when a control circuit 120 receives a signal from a sensor 130 that indicates an operating condition that exceeds a predefined threshold, the electrical current to one or more of the first and/or second LEDs 110A, 110B may be temporarily interrupted at repeated intervals. As illustrated in FIGS. 2A and 2B, since the light emitted from the lighting apparatus 100 includes a combined light from first LEDs 110A and second LEDs 110B that include different emission characteristics from the first LEDs 110A, when the electrical current is temporarily interrupted to one or more of the first and/or second LEDs 110A, 110B, the light emitted from the lighting apparatus provides an appearance of a flashing light pattern. For example, if electrical current is temporarily interrupted to the first LEDs 110A but maintained to the second LEDs 110B in response to detection of a, the light pattern emitted from the lighting apparatus 100 appears to alternatingly include emission characteristics of the first and second LEDs 110A, 110B followed by emission characteristics of the second LEDs 110B only.

Figure 3A:
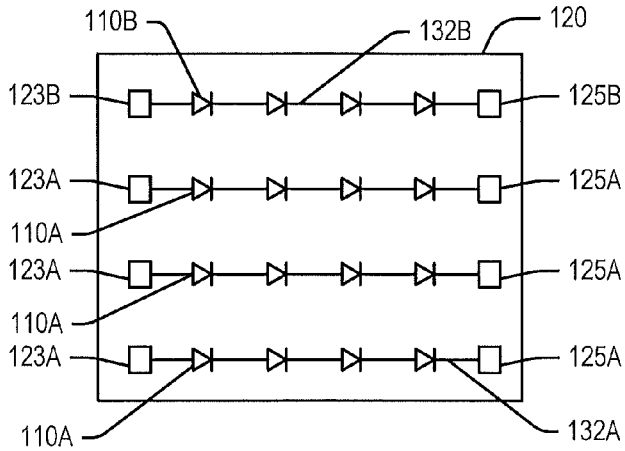
FIGS. 3A and 3B are schematics of emitter strings of different respective configurations of a solid state lighting apparatus according to some embodiments of the present invention.
Figure 3B:
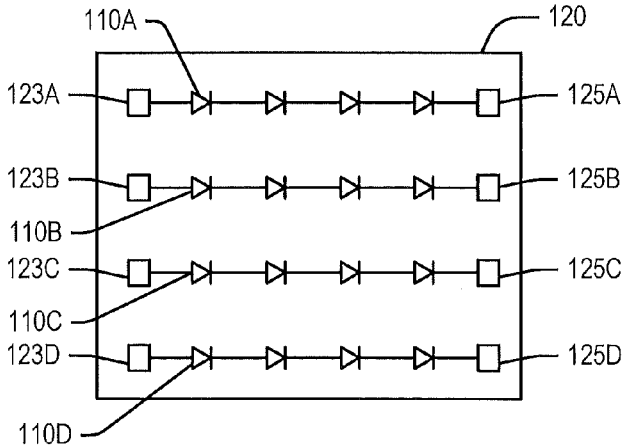

Reference is now made to FIGS. 3A and 3B, which are schematic diagrams of emitter strings of different respective configurations of a solid state lighting apparatus according to some embodiments of the present invention. Referring to FIG. 3A, the LEDs 110A, 110B in the lighting apparatus 100 may be electrically interconnected in respective strings. As shown therein, the LEDs 110A, 110B may be interconnected such that the LEDs 110A are connected in series to form first strings 132A. Likewise, the LEDs 110B may be arranged in series to form a second string 132B. Each string 132A, 132B may be connected to respective anode terminals 123A, 123B and cathode terminals 125A, 125B.

Although four strings 132A, 132B are illustrated in FIG. 3A, it will be appreciated that the lighting apparatus 100 may include more or fewer strings. Furthermore, there may be multiple strings of LEDs 110A, and/or multiple strings of other colored LEDs 110B. Some embodiments provide that electrical current may be temporarily interrupted at repeating intervals for each of the strings 132A, 132B in any combination. In this manner, a control circuit may temporarily interrupt electrical current to strings 132A, for example, while allowing strings 132B to be energized in response to an operating condition that exceeds an established limit. By temporarily interrupting the electrical current to one or more strings of the first and/or second LEDs 110A, 110B responsive to the detected operating condition, the light emitted from the lighting apparatus 100 may change in appearance to provide a visible indicator of the operating condition and/or other information.

Referring to FIG. 3B, the lighting apparatus 100 includes LEDs 110A, 110B, 110C, 110D electrically interconnected in respective strings. As shown therein, the LEDs 110A, 110B, 110C, 110D may be interconnected such that the LEDs 110A are connected in series to form a first string 132A. Likewise, the LEDs 110B may be arranged in series to form a second string 132B, the LEDs 110C may be arranged in series to form a third string 132C, and the LEDs 110D may be arranged in series to form a fourth string 132D. Each string 132A, 132B, 132C, 132D may be connected to respective anode terminals 123A, 123B. 123C, 123D and cathode terminals 125A, 125B, 125C, 125D.

Although four strings 132A, 132B, 132C, 132D are illustrated in FIG. 3B, it will be appreciated that the lighting apparatus 100 may include more or fewer strings. Furthermore, there may be multiple strings of LEDs 110A that emit light of one color, multiple strings of LEDs 110B that emit light of another color, multiple strings of LEDs 110C that emit light of yet another color, and/or multiple strings of LEDs 110D that emit light of still another color. Some embodiments provide that electrical current may be temporarily interrupted at repeated intervals for one or more of the strings 132A, 132B, 132C, 132D in any combination. In this manner, a control circuit may selectively interrupt electrical current to string 132A, for example, while allowing strings 132B, 132C, 132D to be energized in response to an operating condition that exceeds an established limit. In the event that an undesirable operating condition is persistent, a control circuit may alternate the temporary interruption among multiple ones of the strings 132A, 132B, 132C, 132D. For example, electrical current to string 132A may be temporarily interrupted for a determined time interval and then restored while electrical current to string 132B is interrupted. By effectively rotating which of the strings 132A, 132B, 132C, 132D are energized during the undesirable operating condition, potential life shortening and/or performance diminishing effects to any one or set of strings may be reduced and/or equalized among all of the strings.

Additionally, although examples described herein are generally directed to binary groupings of color, it will be appreciated that ternary, quaternary and higher-order versions may also be utilized, in which a metameric grouping includes three or more LED device types.

In some embodiments of the present invention, the control circuit 120 of the solid state lighting apparatus 100 of FIG. 1 may include comparator functions and/or devices for comparing the received temperature signal to the high temperature limit and/or the restore function temperature. In particular, as discussed below with reference to FIG. 4, outputs from the comparator functions and/or devices may be received by latching circuits including astable multivibrator circuits, among others. For example, in some embodiments, a set-reset (SR) flip-flop may be used to temporarily change, set, and/or maintain an output state corresponding to a value of the temperature signal relative to the high temperature limit and/or the restore function temperature.

Figure 4:
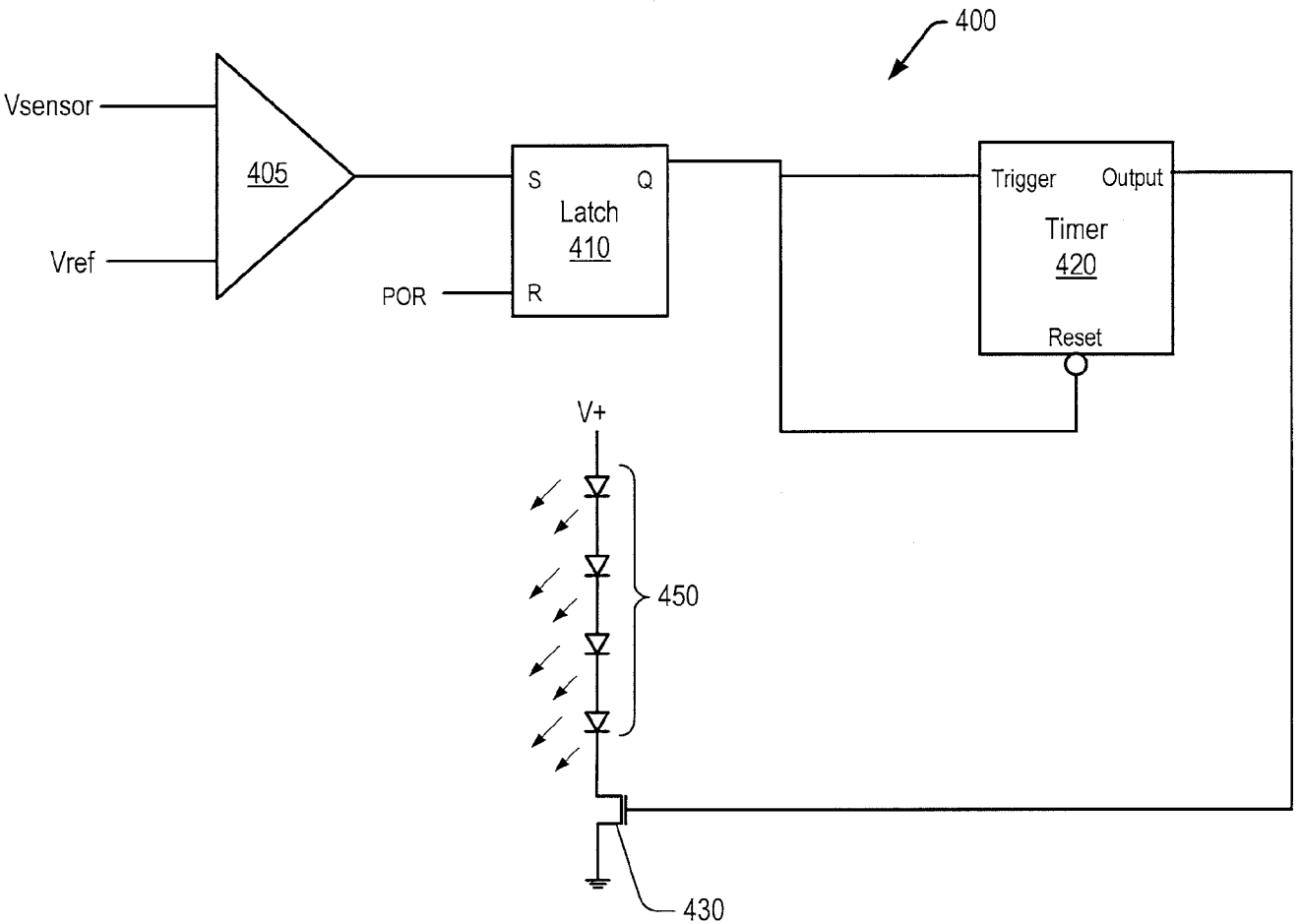
FIG. 4 is a block diagram illustrating exemplary control logic of a solid state lighting apparatus and/or methods of providing visible alert signals according to some embodiments of the present invention.

FIG. 4 is a block diagram illustrating a signaling circuit 400 for use in a solid state lighting apparatus according to some embodiments of the present invention, such as the apparatus 100 of FIG. 1. As shown in the embodiment of FIG. 4, a transistor 430 is used to temporarily interrupt and/or otherwise control current flow through a string of light emitting diodes 450. The transistor 430 is controlled by the output of a timer 420. The timer 420 may be set to function as an astable multivibrator to provide the desired on-time and off-time for the light emitting diode string 450 so as to provide the visible indicator to a user. In the embodiment of FIG. 4, the timer 420 is triggered when an output signal from a thermocouple (not shown) at a location that reflects the junction temperature of the light emitting diodes 450 exceeds a threshold value; however, as discussed above, other sensors for detecting detrimental operating conditions (e.g., optical sensors, humidity sensors, etc.) and corresponding output signals therefrom may be used. The threshold value can be set by a reference voltage Vref, and the value of the thermocouple output signal Vsensor may be compared to the reference voltage Vref by a comparator 405. If the value of the thermocouple output signal Vsensor exceeds the reference voltage Vref, a set/reset (SR) latch 410 is used to trigger the timer 420. The SR latch 410 remains set until a power-on-reset (POR) signal is received, which resets the SR latch 410. The POR signal may be provided, for example, when a user cycles power to the lighting apparatus. Thus, the timer 420 provides a switching signal that repeatedly turns the transistor 430 (and thus, the light emitting diodes 450) off and on at respective intervals and for respective durations sufficient to provide an appearance of a flashing light pattern in the light emitted by the light emitting diodes 450. The timer 420 provides the switching signal until a power is cycled to the device, independent or regardless of whether the junction temperature of the light emitting diodes 450 is reduced by the on/off cycling. However, as the on/off cycling of the light emitting diodes 450 may at least somewhat reduce the junction temperature, the likelihood of significant damage to the light emitting diodes 450 may be reduced.

In some embodiments, a thermal switch may also be used in conjunction with the signaling circuit 400 to disable the light emitting diodes 450 if the lighting module or apparatus overheats to further reduce the likelihood of significant damage. The use of such a thermal switch may, however, require a user to be present when the high temperature condition occurs, so that the user may be aware of the visible indicator prior to disabling, of the light emitting diodes 450. In particular, if a lighting module overheats and subsequently cools down, the thermal switch could be reset so that the module produces light again. However, as the time for the thermal switch to reset may vary, the user may think the light has broken or is otherwise inoperable because it may not turn on in response to cycling the power to the module. As such, a functioning lighting apparatus could be inadvertently discarded if the user is not present when the visible indicator is provided. Accordingly, in some embodiments, the visible indicator of the detrimental operating condition may not be provided coincidental or contemporaneous in time with the occurrence of the condition. For example, the visible indicator may be provided for a brief amount of time upon power-up of the solid state lighting apparatus to indicate that a detrimental operating condition occurred during the immediately preceding usage of the lighting apparatus.

Additionally, in some embodiments, the current provided to the light emitting diodes 450 could be reduced, to thereby reduce and/or eliminate the high temperature condition. As such, the visible indicator of the high temperature condition may be provided only occasionally, in conjunction with the reduced current, to indicate that the current has been reduced. For example, if a high temperature condition or thermal overload is detected, the current could be reduced until the condition is eliminated or reduced to a level within the designed operating range. Periodically, e.g., every five minutes, the light emitting diodes 450 can be flashed (e.g., turned off and on) and/or the light output from the apparatus could change color to indicate the fault condition. As such, a combination of current reduction and temporary current interruption can be used to provide a visible indicator of the presence of a undesired operating condition, as well as to reduce and/or eliminate the undesired operating condition. In addition to simply flashing a repeating sequence or light pattern, the light pattern could be established based on the type of undesired operating condition detected, the severity of the operating condition, the current reduction required to reduce and/or eliminate a thermal overload condition, the ambient conditions of the thermal overload, and/or other diagnostic information.

Figure 5:
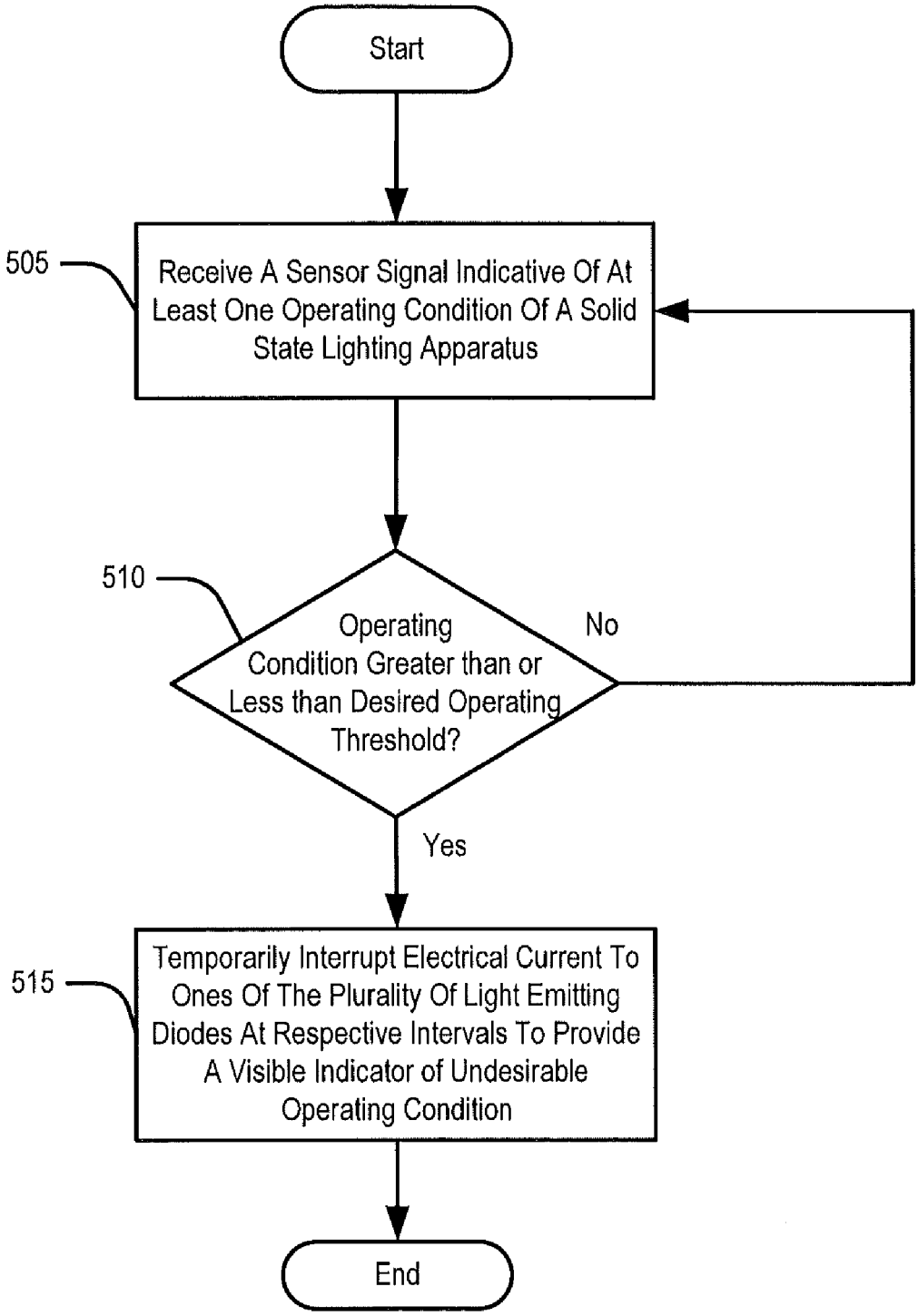
FIG. 5 is a flowchart illustrating operations of a solid state lighting apparatus for providing visible alert signals according to some embodiments of the present invention.

FIG. 5 is a flowchart illustrating operations of a solid state lighting apparatus for providing visible alert signals according to some embodiments of the present invention. For example, the operations of FIG. 5 may be performed by a control circuit of a solid state lighting apparatus, such as the control circuit 120 of the apparatus 100 of FIG. 1. Referring now to FIG. 5, operations begin at Block 505 when a sensor signal indicative of at least one operating condition of a solid state lighting apparatus is received from a sensor. For example, the sensor signal may be a temperature signal received from a thermal sensor, and may indicate a current junction temperature of one or more solid state emitters (e.g., LEDs) in the lighting apparatus. In some embodiments, the temperature may correspond to an ambient temperature.

At Block 510, it is determined whether the operating condition indicated by the sensor signal is greater than a desired operating threshold. In particular, a value of the sensor signal may be compared to a value indicative of the desired operating threshold, for example, using a comparator function, circuit and/or device. Some embodiments provide that the desired operating threshold may correspond to a fixed value, while some embodiments may provide that the desired operating threshold may be variable, adjustable, and/or selectable from a plurality of values. If the value of the sensor signal is not greater than the value of the desired operating threshold, then the lighting apparatus continues to operate according to normal conditions and the sensor signal is again received at Block 505 to provide an updated value. The sensor signal may be continuously and/or intermittently updated.

However, if the value of the sensor signal exceeds the value of the desired operating threshold and/or is otherwise outside a desired operating range, then electrical current is temporarily interrupted to ones of the LEDs at respective intervals to turn those LEDs off and on at Block 515. For example, current may be temporarily interrupted to all of the LEDs at repeating intervals when the sensor signal indicates a temperature that is greater than a high temperature limit for the LEDs, so that the lighting apparatus provides a flashing light pattern as a visible indicator of the detrimental operating condition. In some embodiments, current may be maintained to one or more of the LEDs such that those LEDs remain "on" while current is temporarily interrupted to the ones of the LEDs at the respective intervals. The LEDs that are turned off and on may be operable to emit light in a dominant wavelength that is different than the dominant wavelength of light emitted from ones of the LEDs that remain on. In this manner, the light emitted from the lighting apparatus alternates or flashes between a combined light output corresponding to a combination of the different wavelengths, and a light output corresponding to less than the total combined different wavelengths. For example, the lighting apparatus may include a first portion of LEDs that are operable to emit substantially non-white light using, for example, a BSY emitter, and a second portion of LEDs that are operable to emit substantially red light. In response to the high temperature condition, the BSY LEDs may be turned off while the red LEDs may continue to emit light. Accordingly, the light emitted from the lighting apparatus will provide the appearance of flashing between a warm white light and a substantially red light responsive to an operating condition in excess of a desired threshold.

Figure 6:
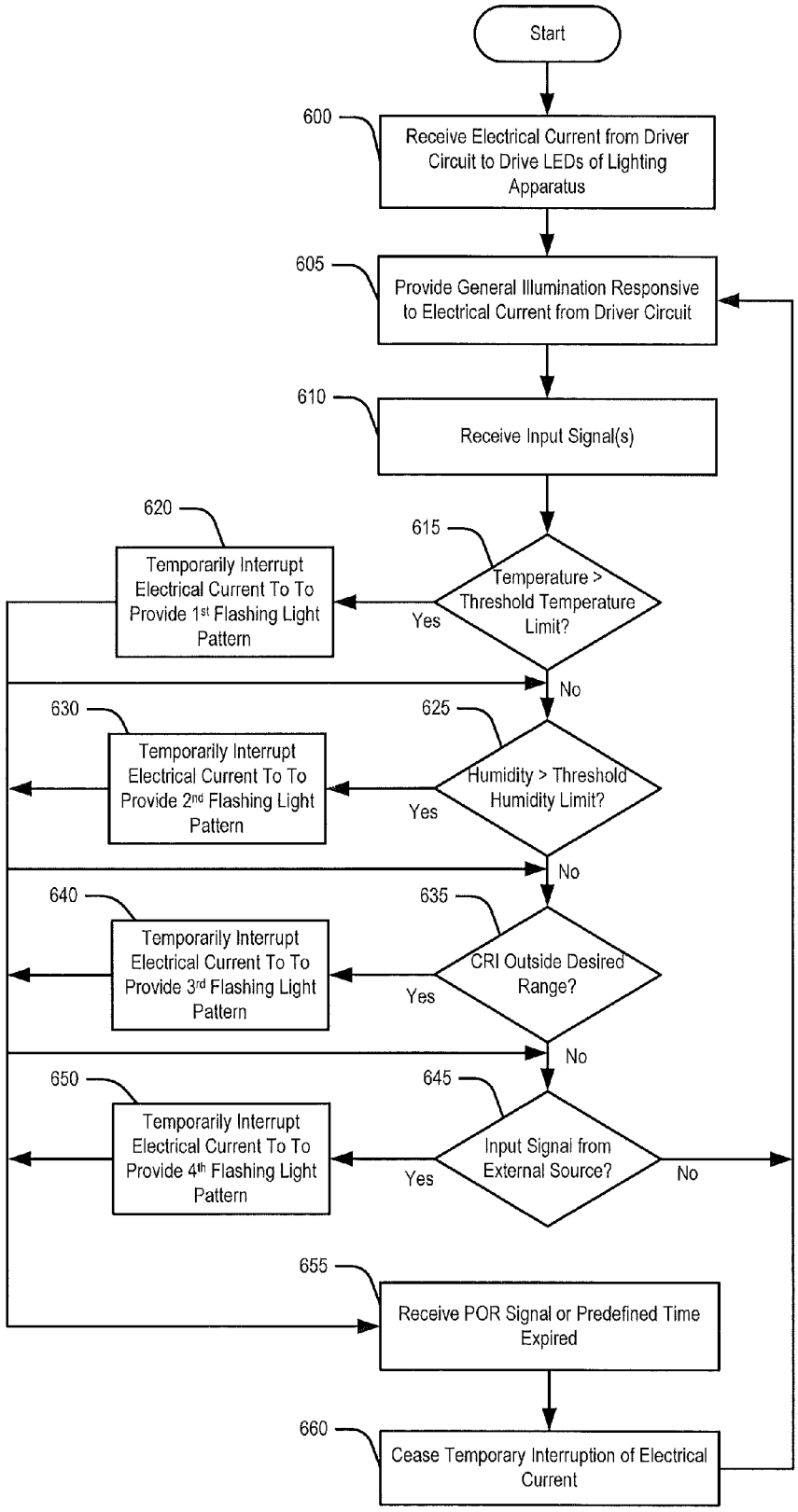
FIG. 6 is a flowchart illustrating operations of a solid state lighting apparatus for providing visible alert signals according to further embodiments of the present invention.

FIG. 6 is a flowchart illustrating operations of a solid state lighting apparatus for providing visible alert signals according to further embodiments of the present invention. Referring now to FIG. 6, a solid state lighting apparatus provides general illumination in the form of warm white light output at Block 605 responsive to electrical signals received from a driver circuit at Block 600. Additional input signals are received at Block 610. For example, the input signals may be received from one or more sensors configured to detect various operating conditions of the lighting apparatus (such as temperature, humidity, and/or optical sensors), and/or from an external source (such as a backup power source or emergency broadcast source).

At Block 615, it is determined whether a present temperature indicated by one of the input signals exceeds a high temperature limit, and if so, the electrical current from the driver circuit is temporarily interrupted to one or more of the LEDs at repeating intervals to provide a first flashing light pattern at Block 620. The present temperature may indicate a junction temperature of one or more LEDs of the lighting apparatus, or may indicate an ambient temperature for the operating environment of the lighting apparatus. The first flashing light pattern may also indicate a severity of the high temperature condition by turning one or more of the LEDs off and on at a different frequency, for a different duration, and/or to provide a flashing light pattern of a different color, as discussed above.

At Block 625, it is determined whether a present humidity level indicated by one of the input signals exceeds a moisture limit, and if so, the electrical current from the driver circuit is temporarily interrupted to one or more of the LEDs at repeating intervals to provide a second flashing light pattern at Block 630. The second flashing light pattern may be different from the first flashing light pattern in frequency, duration, and/or color, and may indicate a severity of the high humidity condition by turning the LEDs off and on, for example, in any manner described above.

At Block 635, it is determined whether a present color rendering index (CRI) indicated by one of the input signals is within a desired CRI range or tolerance. If not, the electrical current from the driver circuit is temporarily interrupted to one or more of the LEDs at repeating intervals to provide a third flashing light pattern at Block 640. The third flashing light pattern may differ from the first and/or second flashing light patterns in frequency, duration, and/or color.

At Block 645, it is determined whether one of the input signals is received from an external source, and if so, the electrical current from the driver circuit is temporarily interrupted to provide a fourth flashing light pattern at Block 650. The fourth flashing light pattern may differ from the first, second, and/or third flashing light patterns in frequency, duration, and/or color, and may be used to indicate a variety of information by turning the LEDs off and on, for example, in any manner described above. It will be understood that the first, second, third, and/or fourth flashing light patterns may be provided in a sequential manner and/or in an alternating manner responsive to the corresponding input signals to provide visible indicators of their respective conditions.

At Block 655, a power-on-reset signal is received or a predefined amount of time has expired. In response, temporary interruption of current to the LEDs is ceased at Block 660, and the solid state lighting apparatus resumes general illumination at Block 605 to provide warm white light output responsive to the drive signals from the driver circuit.

The flowcharts of FIGS. 5 and 6 illustrate the architecture, functionality, and operations of embodiments of hardware and/or software according to various embodiments of the present invention. It will be understood that each block of the flowchart and/or block diagram illustrations, and combinations of blocks in the flowchart and/or block diagram illustrations, may be implemented by computer program instructions and/or hardware operations. In this regard, each block represents a module, segment, or portion of code, which comprises one or more executable instructions for implementing the specified logical function(s). It should be noted that, in other implementations, the function(s) noted in the blocks may occur out of the order noted in FIGS. 5 and 6. For example, two blocks shown in succession may, in fact, be executed substantially concurrently, or the blocks may sometimes be executed in the reverse order, depending on the functionality involved.

The computer program instructions may be provided to a processor of a general purpose computer, a special purpose computer, or other programmable data processing apparatus to produce a machine, such that the instructions, which execute via the processor of the computer or other programmable data processing apparatus, create means for implementing the functions specified in the flowchart and/or block diagram block or blocks. The computer program instructions may also be stored in a computer usable or computer-readable memory that may direct a computer or other programmable data processing apparatus to function in a particular manner, such that the instructions stored in the computer usable or computer-readable memory produce an article of manufacture including instructions that implement the function specified in the flowchart and/or block diagram block or blocks.

Accordingly, a solid state lighting apparatus according to embodiments of the present invention is configured to provide general illumination in a primary operating mode responsive to operation of a driver circuit or other power supply, and is configured to provide a visible indicator of an undesirable or detrimental operating condition in a secondary or troubleshooting operating mode responsive to operation of a control circuit that temporarily interrupts the flow of electrical current to the LEDs of the lighting apparatus. As the visible indicator only interrupts the general illumination function of the lighting apparatus in a temporary manner, a user of the lighting apparatus is unlikely to confuse the visible indicator with a defect and/or failure of the lighting apparatus.

In the drawings and specification, there have been disclosed typical embodiments of the invention and, although specific terms are employed, they are used in a generic and descriptive sense only and not for purposes of limitation, the scope of the invention being set forth in the following claims.

That which is claimed:

1. A solid state lighting apparatus, comprising:

a plurality of light emitting diodes;

a sensor configured to output a sensor signal indicative of at least one operating condition of the solid state lighting apparatus; and a control circuit coupled to the sensor and configured to temporarily interrupt electrical current to at least one but not all of the plurality of light emitting diodes responsive to the sensor signal to provide a visible indicator of the operating condition.

2. A solid state lighting apparatus, comprising:

a plurality of light emitting diodes;

a sensor configured to output a sensor signal indicative of at least one operating condition of the solid state lighting apparatus; and a control circuit coupled to the sensor and configured to temporarily interrupt electrical current to at least one but not all of the plurality of light emitting diodes responsive to the sensor signal to provide a visible indicator of the operating condition, wherein the control circuit is configured to temporarily interrupt the electrical current for at least two intervals of respective durations sufficient to temporarily interrupt general illumination provided by the solid state lighting apparatus and provide an appearance of a flashing light pattern that is detectable by a human eye in light emitted by the apparatus.

3. The solid state lighting apparatus of claim 2, wherein the sensor signal indicates that the operating condition differs with respect to a desired operating threshold.

4. The solid state lighting apparatus of claim 3, wherein the control circuit is configured to cease interruption of the electrical current to the one of the plurality of light emitting diodes responsive to a subsequent value of the sensor signal indicating that the operating condition meets the desired operating threshold.

5. The solid state lighting apparatus of claim 3, wherein the control circuit is configured to temporarily interrupt the electrical current to the one of the plurality of light emitting diodes independent of a time at which the sensor signal indicates that the operating condition does not meet the desired operating threshold.

6. The solid state lighting apparatus of claim 2, wherein the solid state lighting apparatus is configured to provide the general illumination responsive to operation of a driver circuit that is configured to provide the electrical current to the plurality of light emitting diodes.

7. The solid state lighting apparatus of claim 2, wherein the plurality of light emitting diodes comprises a first plurality of light emitting diodes, and further comprising:

a second plurality of light emitting diodes configured to emit light having a different dominant wavelength than that of the first plurality of light emitting diodes, wherein the control circuit is further configured to maintain the electrical current to the second plurality of light emitting diodes responsive to the sensor signal.

8. The solid state lighting apparatus of claim 2, wherein the respective intervals comprise periodic intervals.

9. The solid state lighting apparatus of claim 8, wherein the operating condition comprises one of a plurality of operating conditions, and wherein the flashing light pattern indicates the one of the plurality of operating conditions based on respective durations for which the electrical current is temporarily interrupted, based on a period of the intervals, and/or based on a color of light emitted by the apparatus.

10. The solid state lighting apparatus of claim 8, wherein the flashing light pattern indicates a severity of the operating condition based on respective durations for which the electrical current is temporality interrupted, based on a period of the respective intervals, and/or based on a color of the light emitted by the apparatus.

11. The solid state lighting apparatus of claim 2, wherein the sensor comprises a thermal sensor, and wherein the operating condition comprises a junction temperature and/or an ambient temperature of an operating environment of at least one of the plurality of light emitting diodes.

12. The solid state lighting apparatus of claim 2, wherein the sensor comprises an optical sensor, and wherein the operating condition comprises a color rendering index (CRI) for the solid state lighting apparatus.

13. The solid state lighting apparatus of claim 2, wherein the sensor comprises a humidity sensor, and wherein the operating condition comprises a humidity level of an operating environment of the solid state lighting apparatus.

14. The solid state lighting apparatus of claim 2, further comprising:

an external interface configured to receive an external input signal, wherein the control circuit is further configured to temporarily interrupt the electrical current to at least one of the plurality of light emitting diodes responsive to the external input signal to provide a second visible indicator independent of the operating condition indicated by the sensor signal.

15. The solid state lighting apparatus of claim 2, wherein the respective durations of the at least two intervals are different.

16. A solid state lighting apparatus, comprising:

a plurality of light emitting diodes;

a sensor configured to output a sensor signal indicative of at least one operating condition of the solid state lighting apparatus; and a control circuit coupled to the sensor and configured to temporarily interrupt electrical current to at least one of the plurality of light emitting diodes responsive to the sensor signal to provide a visible indicator of the operating condition, wherein the control circuit comprises:

a comparator circuit configured to compare a sensor signal value to a desired operating threshold value, and to either provide a fault signal responsive to the sensor signal value being greater than the desired operating threshold value or provide the fault signal responsive to the sensor signal value being less than the desired operating threshold value; and a timer circuit configured to provide a switching signal to temporarily interrupt the electrical current at respective intervals responsive to the fault signal.

17. A solid state lighting apparatus, comprising:

a plurality of light emitting diodes;

a sensor configured to output a sensor signal indicative of at least one operating condition of the solid state lighting apparatus; and a control circuit coupled to the sensor and configured to temporarily interrupt electrical current to at least one but not all of the plurality of light emitting diodes responsive to the sensor signal to provide a visible indicator of the operating condition, wherein the sensor signal indicates that the operating condition differs with respect to a desired operating threshold, and wherein the control circuit is configured to temporarily interrupt the electrical current to the one of the plurality of light emitting diodes independent of a subsequent value of the sensor signal.

18. The solid state lighting apparatus of claim 17, wherein the control circuit is configured to cease interruption of the electrical current to the one of the plurality of light emitting diodes responsive to a power-on-reset signal.

19. A solid state lighting apparatus, comprising:

a plurality of light emitting diodes;

a sensor configured to output a sensor signal indicative of at least one operating condition of the solid state lighting apparatus; and a control circuit coupled to the sensor, wherein, responsive to the sensor signal, the control circuit is configured to temporarily interrupt electrical current to at least one of the plurality of light emitting diodes for intervals having respective durations to provide a visible indicator of the operating condition, wherein the respective durations for which the electrical current is temporarily interrupted and/or a period of the respective intervals are sufficient to reduce a subsequent value of the sensor signal.

20. A method of operating a solid state lighting apparatus including a plurality of light emitting diodes, the method comprising:

receiving, from a sensor, a sensor signal indicative of at least one operating condition of the solid state lighting apparatus; and temporarily interrupting electrical current to at least one but not all of the plurality of light emitting diodes responsive to the sensor signal to provide a visible indicator of the operating condition.

21. A method of operating a solid state lighting apparatus including a plurality of light emitting diodes, the method comprising:

receiving, from a sensor, a sensor signal indicative of at least one operating condition of the solid state lighting apparatus, wherein the sensor signal indicates that the operating condition differs with respect to a desired operating threshold; and temporarily interrupting electrical current to at least one but not all of the plurality of light emitting diodes responsive to the sensor signal to provide a visible indicator of the operating condition, wherein temporarily interrupting the electrical current comprises:

temporarily interrupting the electrical current for at least two intervals of respective durations sufficient to temporarily interrupt general illumination provided by the solid state lighting apparatus and provide an appearance of a flashing light pattern that is detectable by a human eye in light emitted by the apparatus.

22. The method of claim 21, further comprising:

receiving the electrical current from a driver circuit; and providing the electrical current to the plurality of light emitting diodes such that the light emitted by the apparatus provides the general illumination prior to temporarily interrupting the electrical current.

23. The method of claim 21, wherein the plurality of light emitting diodes is a first plurality of light emitting diodes, wherein the solid state lighting apparatus includes a second plurality of light emitting diodes configured to emit light having a different dominant wavelength than that of the first plurality of light emitting diodes, and further comprising:

maintaining the electrical current to the second plurality of light emitting diodes responsive to the sensor signal.

24. The method of claim 21, wherein temporarily interrupting the electrical current comprises:

temporarily interrupting the electrical current at the respective intervals independent of a subsequent value of the sensor signal and/or independent of a time at which the sensor signal indicates that the operating condition does not meet the desired operating threshold.

25. The method of claim 21, further comprising:

receiving an external input signal from an external interface; and temporarily interrupting the electrical current to at least one of the plurality of light emitting diodes responsive to the external input signal to provide a second visible indicator independent of the operating condition indicated by the sensor signal.

26. A solid state lighting apparatus comprising:

means for receiving, from a sensor, a sensor signal indicative of at least one operating condition of the solid state lighting apparatus, wherein the sensor signal indicates that the operating condition differs with respect to a desired operating threshold; and means for temporarily interrupting electrical current to at least one but not all of the plurality of light emitting diodes responsive to the sensor signal to provide a visible indicator of the operating condition, wherein the means for temporarily interrupting the electrical current comprises means for temporarily interrupting the electrical current for at least two intervals of respective durations sufficient to temporarily interrupt general illumination provided by the solid state lighting apparatus and provide an appearance of a flashing light pattern that is detectable by a human eye in light emitted by the apparatus.

27. A method of operating a solid state lighting apparatus, the method comprising:

providing general illumination using a plurality of light emitting diodes;

detecting an operating condition of the solid state lighting apparatus; and controlling current to at least one but not all of the light emitting diodes in response to detecting the operating condition to provide a visible indicator of the operating condition.

28. A method of operating a solid state lighting apparatus, the method comprising:

providing general illumination using a plurality of light emitting diodes;

detecting an operating condition of the solid state lighting apparatus; and controlling current to at least one but not all of the light emitting diodes in response to detecting the operating condition to provide a visible indicator of the operating condition, wherein controlling the current comprises temporarily interrupting the current to the at least one but not all of the light emitting diodes to temporarily interrupt the general illumination and provide the visible indicator of the operating condition, and wherein temporarily interrupting the electrical current comprises temporarily interrupting the current for respective durations sufficient such that light emitted by the apparatus provides an appearance of a flashing light pattern that is detectable by a human eye.

29. A method of operating a solid state lighting apparatus, the method comprising:

providing general illumination using a plurality of light emitting diodes;

detecting an operating condition of the solid state lighting apparatus; and controlling current to at least one of the light emitting diodes in response to detecting the operating condition to provide a visible indicator of the operating condition, wherein controlling the current comprises temporarily interrupting the current to the at least one of the light emitting diodes to temporarily interrupt the general illumination and provide the visible indicator of the operating condition, wherein temporarily interrupting the current comprises:

generating a sensor signal having a signal value indicative of the operating condition;

comparing the signal value to one or more values indicative of a desired operating range;

generating a fault signal responsive to the signal value differing with respect to the one or more values indicative of the desired operating range; and generating a switching signal to temporarily interrupt the current at respective intervals responsive to the fault signal.

30. A method of operating a solid state lighting apparatus including a plurality of light emitting diodes, the method comprising:

receiving, from a sensor, a sensor signal indicative of at least one operating condition of the solid state lighting apparatus; and temporarily interrupting electrical current to at least one of the plurality of light emitting diodes responsive to the sensor signal to provide a visible indicator of the operating condition, wherein temporarily interrupting the electrical current comprises:

comparing a sensor signal value to one or more values indicative of a desired operating range;

generating a fault signal responsive to the sensor signal value differing from the one or more values indicative of the desired operating range; and generating a switching signal to temporarily interrupt the electrical current at respective intervals responsive to the fault signal.

* * * * *